United States Patent [19]

McAbee et al.

[11] Patent Number: 4,951,629

[45] Date of Patent: Aug. 28, 1990

[54] IGNITION TIMING SYSTEM

[76] Inventors: Mac P. McAbee, 4014 Lincoln Pl., Dr., Des Moines, Iowa 50312; Scott G. Campbell, 2518 NE. 102nd Ave., Ankeny, Iowa 50021

[21] Appl. No.: 447,787

[22] Filed: Dec. 8, 1989

[51] Int. Cl.[5] ..... F02P 5/06

[52] U.S. Cl. ..... 123/414; 123/418; 123/613

[58] Field of Search ..... 123/146.5 A, 418, 613, 123/414, 602; 200/24

[56] References Cited

U.S. PATENT DOCUMENTS

| | | | |
|---|---|---|---|
| 1,447,745 | 3/1923 | Atkinson | 200/25 |
| 1,566,888 | 12/1925 | Luckeman | 200/20 |
| 1,811,498 | 6/1931 | Geloso | 200/305 |
| 2,766,338 | 10/1956 | Jamieson et al. | 200/24 |
| 2,997,552 | 8/1961 | Silverschotz | 200/24 |
| 3,270,150 | 8/1966 | Stevens | 200/24 |
| 3,506,796 | 4/1970 | Roschilla | 200/19 A |
| 3,619,634 | 11/1971 | Burson | 123/602 |
| 3,822,686 | 7/1974 | Gallo | 123/146.5 A |
| 3,923,022 | 12/1975 | Scholl | 123/146.5 A |
| 4,121,064 | 10/1978 | Nakajima et al. | 200/19 A |
| 4,275,703 | 6/1981 | Bodig et al. | 123/414 |
| 4,315,487 | 2/1982 | Wyatt, Sr. et al. | 200/19 DC |
| 4,378,004 | 3/1983 | Petrie | 123/414 |
| 4,406,272 | 9/1983 | Kiess et al. | 123/146.5 A |
| 4,508,092 | 4/1985 | Kiess et al. | 123/613 |
| 4,553,427 | 11/1985 | Kuraoka et al. | 123/414 |
| 4,658,103 | 4/1987 | McAbee et al. | 200/19 |
| 4,710,598 | 12/1987 | McAbee et al. | 200/21 |

*Primary Examiner*—Tony M. Argenbright
*Assistant Examiner*—Robert E. Mates
*Attorney, Agent, or Firm*—Zarley, McKee, Thomte, Voorhees & Sease

[57] ABSTRACT

The ignition timing system of the present invention comprises a rotor plate having a plurality of pin receiving holes therein. Several pins may be positioned in the desired holes on the upper surface of the rotor plate. The rotor plate rotates in unison with the camshaft of the engine, and the pins pass through optical sensors which are capable of creating an electrical trigger signal each time a pin passes thereby. Electrical circuitry is connected to the optical sensors for converting the trigger signals into firing signals delivered to the cylinders of the engine. The electrical circuitry includes screw adjustments for adjusting the rpms at which the spark advance is changed. The location of the pins on the rotor plate determines the amount of spark advance which occurs at each level.

11 Claims, 5 Drawing Sheets

IGNITION TIMING SYSTEM

BACKGROUND OF THE INVENTION

This invention relates to an ignition timing system.

Several problems have been encountered with prior art timing systems for internal combustion engines, and certain particular problems have been encountered with ignition systems for motorcycles having two-cylinder engines. When an engine has more than one cylinder, it is necessary to fire each cylinder separately. However, in certain present motorcycle engines, both cylinders are fired at the same time, one of the cylinders being fired during the exhaust cycle, and the other of the cylinders being fired during the power portion of the cycle. This is very inefficient, and sometimes causes back-firing.

Another problem encountered with present ignition systems is the inability to quickly and easily adjust the timing of the firing signal relative to the rotational speed of the engine. As the speed of the engine increases or accelerates, it is desirable to be able to advance the spark relative to the power stroke of the cylinder. When the rpms of the engine are extremely high, such as is sometimes encountered with racing vehicles, it is sometimes desirable to retard the spark relative to the power stroke portion of the piston cycle.

Therefore a primary object of the present invention is the provision of an improved ignition timing system for internal combustion engines.

A further object of the present invention is the provision of an improved ignition timing system which fires multiple cylinders one cylinder at a time.

A further object of the present invention is the provision of an improved ignition timing system which can be easily installed on presently existing vehicles, such as motorcycles or other vehicles.

A further object of the present invention is the provision of an improved ignition firing system which permits the adjustment of the advance of the spark relative to the rotational speed of the engine.

A further object of the present invention is the provision of an improved ignition device which permits adjustment of the various predetermined rpm levels at which the spark advance is changed.

A further object of the present invention is the provision of an improved ignition system which reduces the time which each ignition coil is energized so as to minimize battery drain, a common problem with single fire systems.

A further object of the present invention is the provision of an improved ignition device which permits independent adjustment of the spark advance for each cylinder of the engine.

A further object of the present invention is the provision of an improved ignition system which utilizes LED indicators to aid in the adjustment of the timing cycles of the system.

A further object of the present invention is the provision of an improved ignition system which permits screw adjustment of the various levels of rotational speed at which the advance curve is changed.

A further object of the present invention is the provision of an ignition timing system which utilizes a vacuum sensor to sense low vacuum in the engine during extremely high rpms so as to cause a retarding of the spark at very high engine rpms.

A further object of the present invention is the provision of an improved ignition system which is economical to manufacture, durable in use, and efficient in operation.

SUMMARY OF THE INVENTION

The ignition system of the present invention includes a rotor plate which is adapted to be mounted to and driven by the camshaft of the engine. The rotor plate includes a plurality of pin receptacles or holes which are adapted to receive four different pins. As the rotor plate rotates with the camshaft of the engine, the pins move in a circular path, and pass adjacent two fixed sensors which correspond to the two cylinders of the engine and which are adapted to create an electrical trigger signal each time one of the pins passes closely adjacent thereto. The trigger signals are then passed to an electrical circuit which analyzes the trigger signals, and which controls the advance of the spark relative to the rpms of the engine. As the rpms are increased, the spark is advanced accordingly.

The ignition system includes two settings which determine the time and amount of the spark advance. The pegs can be set in different positions on the rotor plate, and the relative positions of the pegs determine the amount of spark advance which occurs each time the spark advance is changed. Four adjustment screws connected to the electrical circuitry permit adjustment of the particular level of rpms at which the advance is changed. Thus, by adjusting the screws, it is possible to change the particular levels at which the spark advance is changed, and by rearranging the pins on the rotor it is possible to determine the amount of degrees of advance which will occur at each of the various changes.

A vacuum retard is also provided in the present invention, and is connected to the engine to sense a low vacuum in the engine. The retard then sends a signal to the circuitry to retard the spark advance currently being provided to the engine. This vacuum retard is particularly helpful when the accelerator is suddenly depressed during low vacuum (heavy load) operation of the vehicle. The sudden depression of the accelerator will reduce vacuum in the carburetor which causes the vacuum retard to retard the spark of the engine.

It is also an optional feature of the present invention to provide a high speed retard which causes the spark advance to be retarded whenever the engine exceeds a particular high level of rpm.

DESCRIPTION OF THE PREFERRED EMBODIMENT

Figure 1:
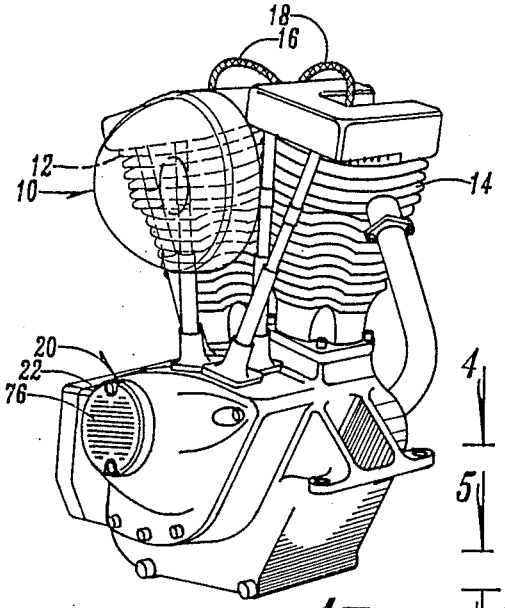
FIG. 1 is a perspective view of a typical internal combustion engine having two cylinders.

Referring to the drawings, the numeral 10 generally designates an internal combustion engine having a first cylinder 12 and a second cylinder 14. Spark plug wires 16, 18 lead to spark plugs (not shown) within each cylinder.

An ignition timing system 20 is mounted to the engine and includes a housing 22 which is centered over the camshaft 24 of the engine. Housing 22 forms a cup 26 having an annular ledge 28 therein and having a bottom wall 30 therein.

Figure 4:
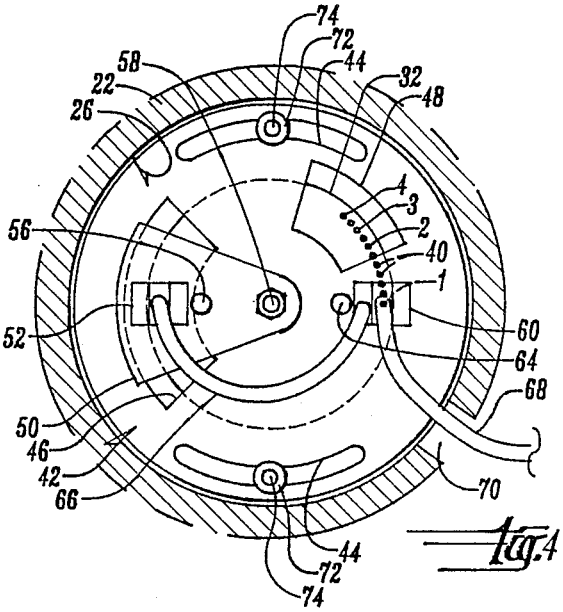
FIG. 4 is a sectional view taken along line 4—4 of FIG. 2.
Figure 5:
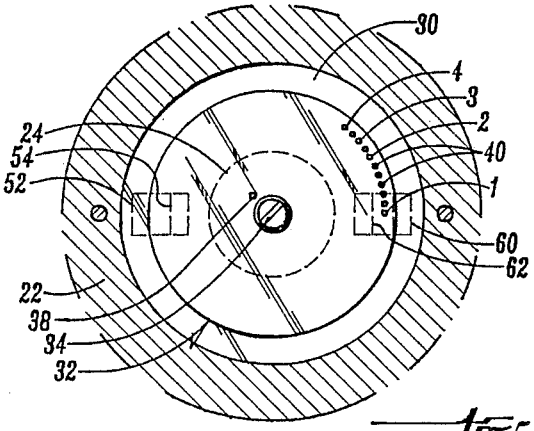
FIG. 5 is a sectional view taken along line 5—5 of FIG. 2.
Figure 6:
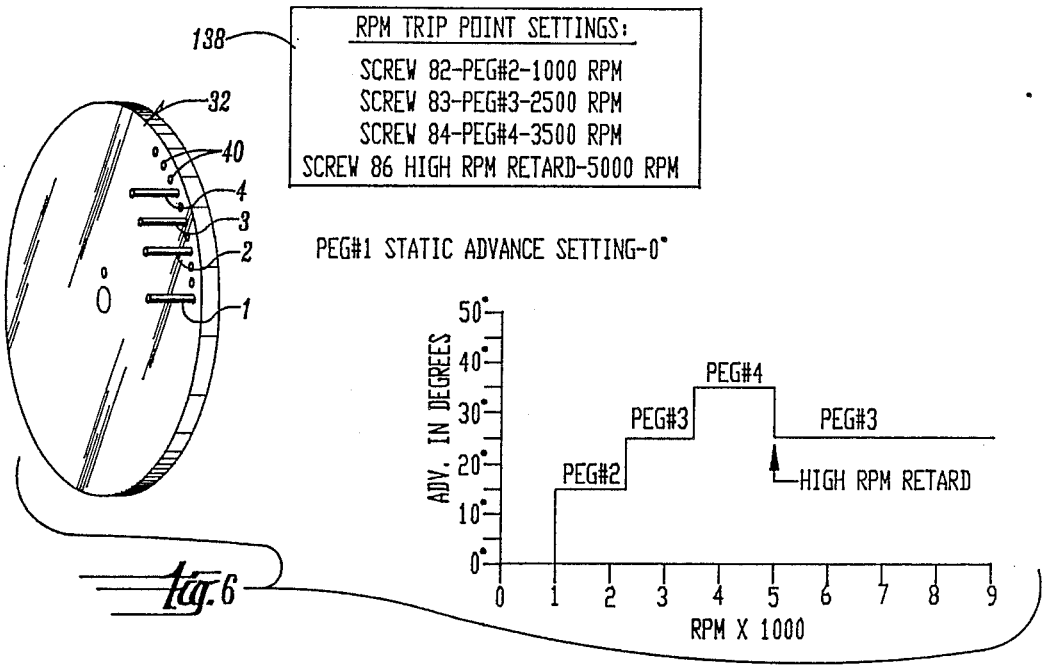
FIG. 6 is a diagram illustrating an example of the rotor/rpm trip point settings which can be achieved with the present invention.

A trigger rotor 32 is circular in shape and is operatively attached to the camshaft 24 by means of a screw 34 which is threaded through trigger rotor 32 and into camshaft 24. Trigger rotor 32 includes a downwardly facing recess 36 which fits over the top of camshaft 24 and includes an alignment pin 38 which protrudes downwardly within a corresponding hole in the upper end of camshaft 24 so as to properly orient and position trigger rotor 32 with respect to camshaft 24. The upper surface of trigger rotor 32 includes a plurality of peg holes 40 (FIGS. 4 and 6) which are located radially outwardly from the rotational axis of camshaft 24 and trigger rotor 32, and which are circumferentially spaced with respect to one another. Mounted within peg holes 40 are four pegs 1, 2, 3, 4 (FIG. 6). The pegs 1–4 can be mounted in a variety of different positions in order to achieve different spark advances according to the selection of the person setting the pegs. The pegs can be moved by merely removing them from the holes 40 and reinserting them into other holes 40. In FIG. 6, the range of spark advance represented by holes 40 is from 0° to 50°, but this range can be varied without detracting from the invention.

Figure 2:
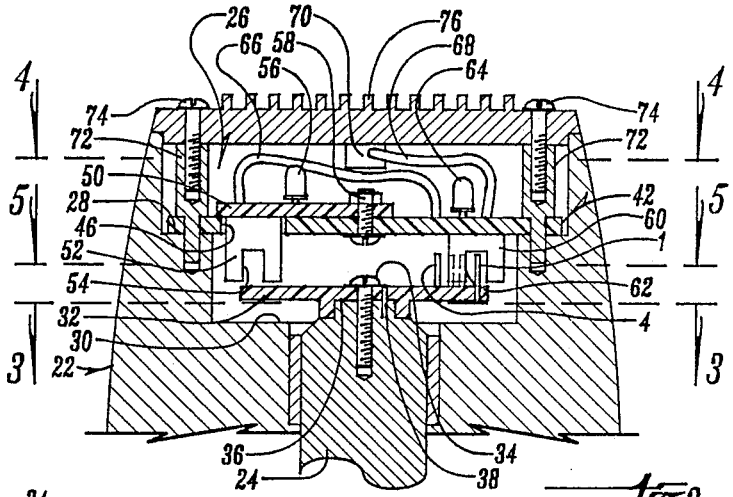
FIG. 2 is a sectional view of the ignition housing containing the moving parts of the present invention.
Figure 3:
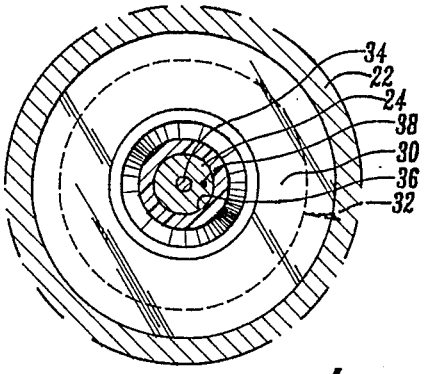
FIG. 3 is a sectional view taken along line 3—3 of FIG. 2.

A trigger plate 42 is mounted within cup 26 and rests upon the annular ledge 28 therein. Trigger plate 42 includes a pair of arcuate retainer slots 44, a sensor slot 46, and a viewing slot 48. A movable sensor plate 50 includes a movable sensor 52 extending downwardly through sensor slot 46 and having a U-shaped slot 54 (FIG. 2) downwardly presented therebelow. An LED 56 is mounted on the upper surface of movable sensor plate 50. Sensor plate 50 is attached to trigger plate 42 by means of a nut and bolt assembly 58. The sensor plate 50 may be moved about the rotational axis provided by bolt 58 to a variety of positions in order to achieve the desired location. Then bolt 58 can be tightened down to hold sensor plate 50 in place.

A fixed sensor 60 is also connected to the bottom surface of sensor plate 50 and includes a downwardly presented U-shaped slot 62 similar to slot 54 of movable sensor 52. An LED 64 is mounted above fixed sensor 60. An electric cable 66 connects the movable sensor 52 and the fixed sensor 60. A second electric cable 68 extends outwardly through an outlet opening 70 in the housing 22. Trigger plate 42 is attached to housing 22 by means of first bolts 72. A pair of second bolts 74 extend downwardly through a cap 76 and are threaded into the upper ends of first bolts 72.

Figure 7:
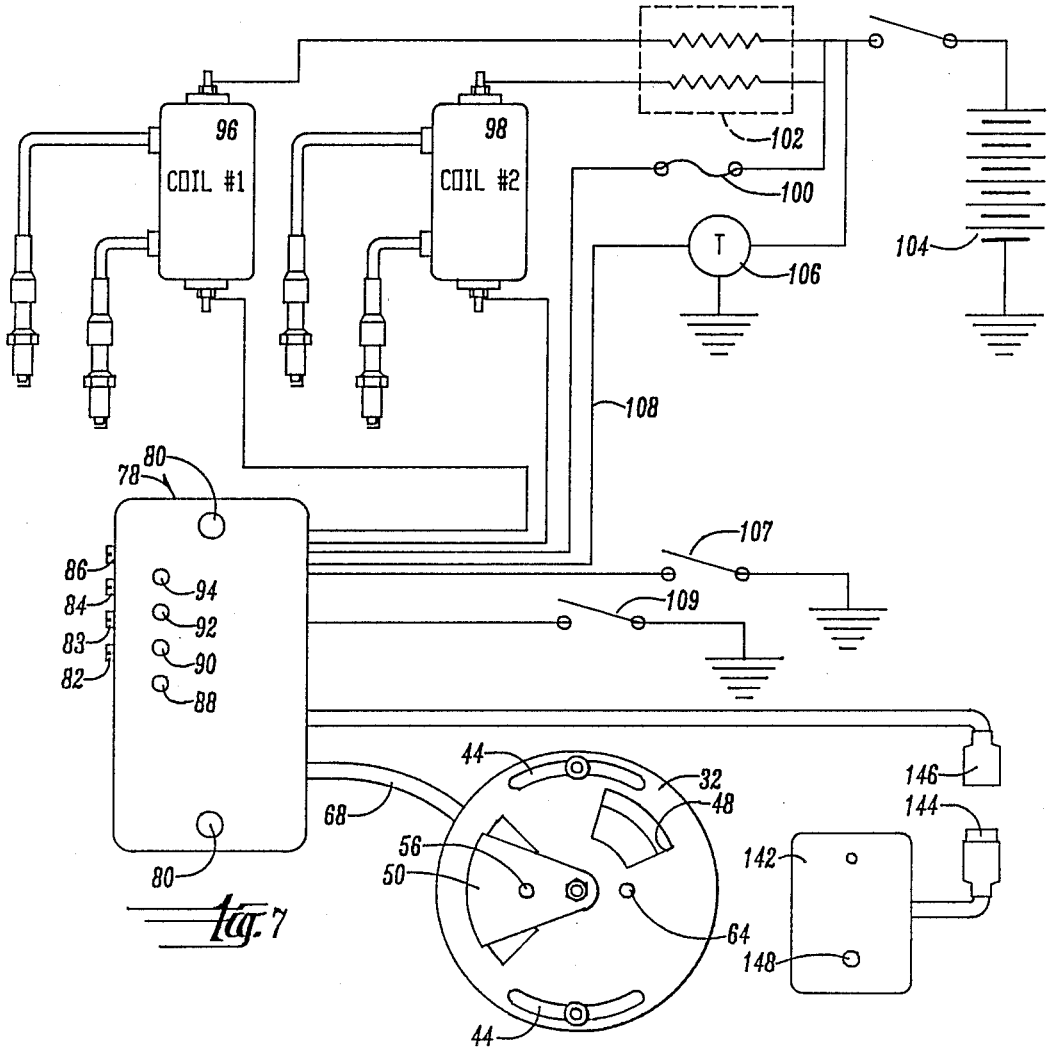
FIG. 7 is a schematic view illustrating the various components of the present invention.

Referring to FIG. 7, the cable 68 extends to a control box 78 containing electrical circuitry therein. Control box 78 includes mounting holes 80 for mounting the control box in a desirable location relative to the housing 20. Control box 78 includes an adjustment screw 82 which is adapted to control the rpms at which the spark advance will be changed from peg 1 to peg 2. Adjustment screw 83 adjusts the rpms at which the spark advance is controlled by peg 3. Adjustment screw 84 controls the rpms at which the spark advance is controlled by peg 4. An adjustment screw 86 is adapted to control the rpms at which the spark advance is retarded from peg 4 to peg 3. Control box 78 also includes an LED 88 which is lit when the rpms exceed the setting set by adjustment screw 82. An LED 90 is adapted to be lit when the rpms exceed the setting of adjustment 83. An LED 92 is adapted to be lit when the rpms exceed the setting of adjustment 84. An LED 94 is adapted to be lit when a vacuum switch to be described hereafter has been closed.

A conventional firing coil 96 is adapted to control the firing of cylinder 1, and a similar coil 98 is adapted to fire cylinder 2. The circuitry also includes a fuse 100, optional resistors 102 (which are used for six volt coils only), and a battery 104. A tachometer 106 is connected by a tachometer cable 108 to the electrical circuitry within control box 78. A vacuum retard switch 107 is mounted on the engine for sensing a vacuum in the carburetor of the engine. A retard switch 107 is connected to the electrical circuitry within control box 78 for causing the retarding of the spark advance from the setting of peg 4 to peg 3 whenever a predetermined vacuum is sensed within the carburetor. A high rpm retard enable switch 109 is adapted to enable the high rpm spark retard whenever the rpms exceed the setting on adjustment screw 86.

Figure 8:
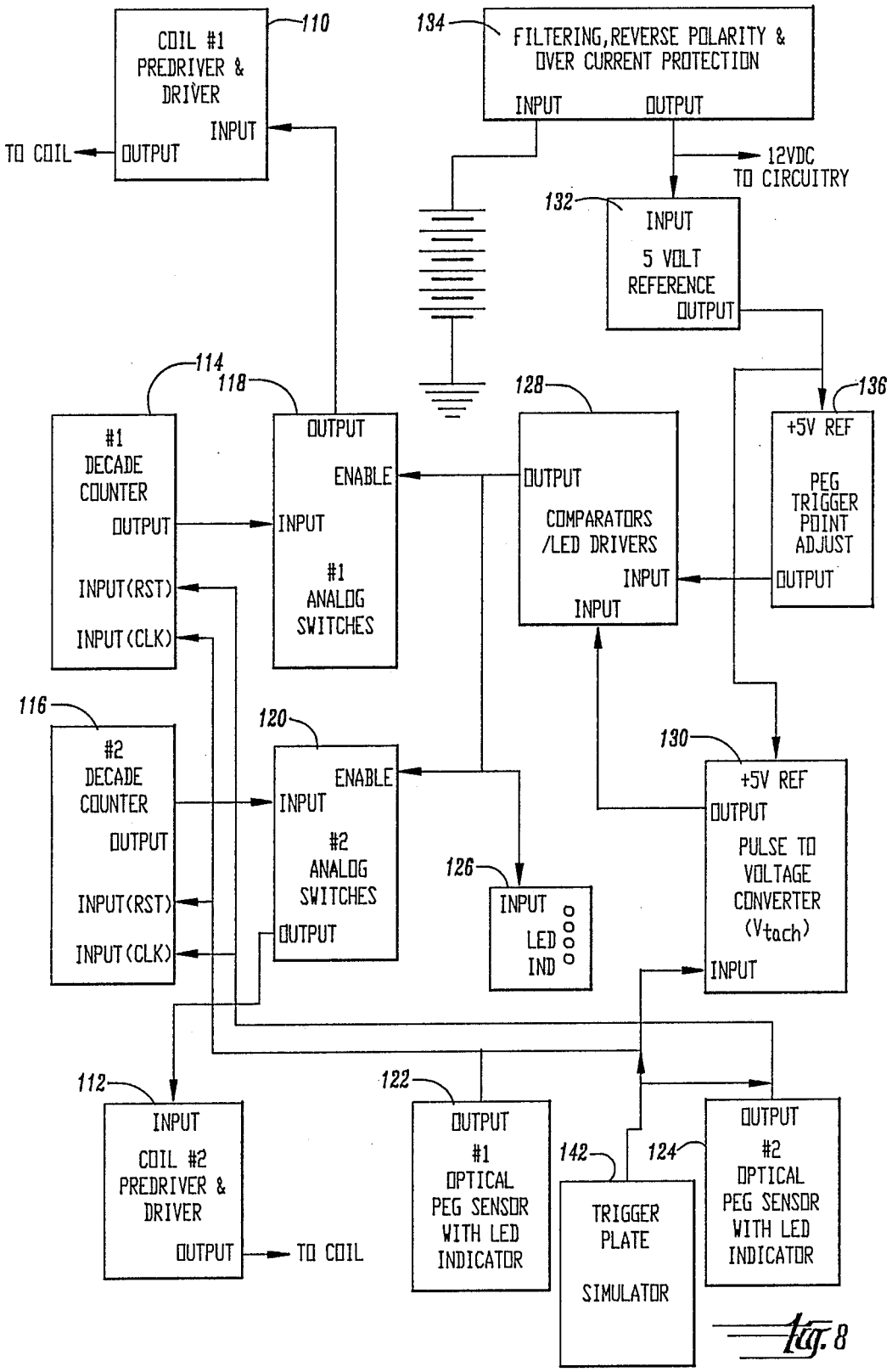
FIG. 8 is a block diagram of the electrical components of the present invention.

FIG. 8 is a block diagram illustrating the circuitry contained within control box 78. The circuitry includes first and second coil drivers 110, 112; first and second decade counters 114, 116; first and second analog switches, 118, 120; first and second optical sensor circuits, 122, 124; an LED circuit 126; a comparator circuit, 128; a pulse to voltage converter, 130; a volt reference circuit 132; a filtering circuit, 134; and a trigger point adjust circuit, 136.

In operation, the first and second optical sensor circuits 122, 124, each sense when the four pegs, 1, 2, 3, 4 pass through the U-shaped slots 54, 62 respectively of the optical sensors 52, 60 respectively. Each sensor 52, 60 senses each of the four pins as they pass by. A trigger signal is sent from each of the optical sensor circuits 122, 124, each time one of the pegs 1, 2, 3, 4 passes by. The trigger signal is sent to the decade counter circuits 114, 116 respectively. These decade counter circuits in combination with their corresponding analog switching circuits 118, 120 prepare a firing signal to be sent to each of the coil drivers 110, 112 respectively.

The pulse voltage converter 130 also receives the trigger signals from the optical sensors 122, 124, and converts these signals to an rpm signal corresponding to the rotational speed of the rotor 24. This rpm signal is then transmitted to the comparator circuit 128. Comparator circuit 128 has been preprogrammed by virtue of the adjustments of screws 82, 83, 84, and 86 so as to enable the analog switches 118, 120 to cause coil drivers 110, 112 to send a firing signal to the coils of the two cylinders.

FIG. 6 illustrates the manner in which the circuitry controls the spark advance timing of the firing signals to the cylinders. The pegs 1, 2, 3, and 4 are located as desired in the various receptacles 40 of trigger rotor 32. Peg 1 is set in the peg hole 40 representing zero degrees advance. Peg 2 is shown set in the peg hole representing the 15 degree advance; peg 3 in the 25 degree advance; and peg 4 in the 45 degree advance. At the same time, as is shown in box 138, screw 82 is set to change the advance from peg 1 to peg 2 at 1,000 rpms. Screw 83 is set to change the spark advance from peg 2 to peg 3 at 2,500 rpms; and Screw 84 is set to change the spark advance from peg 3 to peg 4 at 3,500 rpms. Screw 86 is set to cause the retard spark advance to occur at any time the engine exceeds 5,000 rpms, and will cause the spark advance to receed from peg 4 to peg 3. The graph in FIG. 6 illustrates the spark advance which is achieved by this setting as the rpms of the engine increase from zero through 9,000 rpms.

The operator can observe the changing of the spark advance by observing the LEDs 88, 90, 92, and 94 on the outside of housing 78. When the spark advance is controlled by peg 1, none of the LEDs are lit. When the spark advance is controlled by peg 2, only LED 88 is lit. When the spark advance is controlled by peg 3, both LEDs 88, 90 are lit. When the spark advance is controlled by peg 4, all three of the LEDs 88, 90, and 92 are lit. When the velocity of the vehicle exceeds 5,000 rpms, the LEDs 88, 90 are lit, but LED 92 is unlit.

When a low vacuum is encountered within the carburetor of the vehicle as might occur when the accelerator is suddenly depressed, the LED 94 will become lit, and the spark advance will drop back to be controlled by peg 3 with only LEDs 88, 90 being lit.

Figure 9:
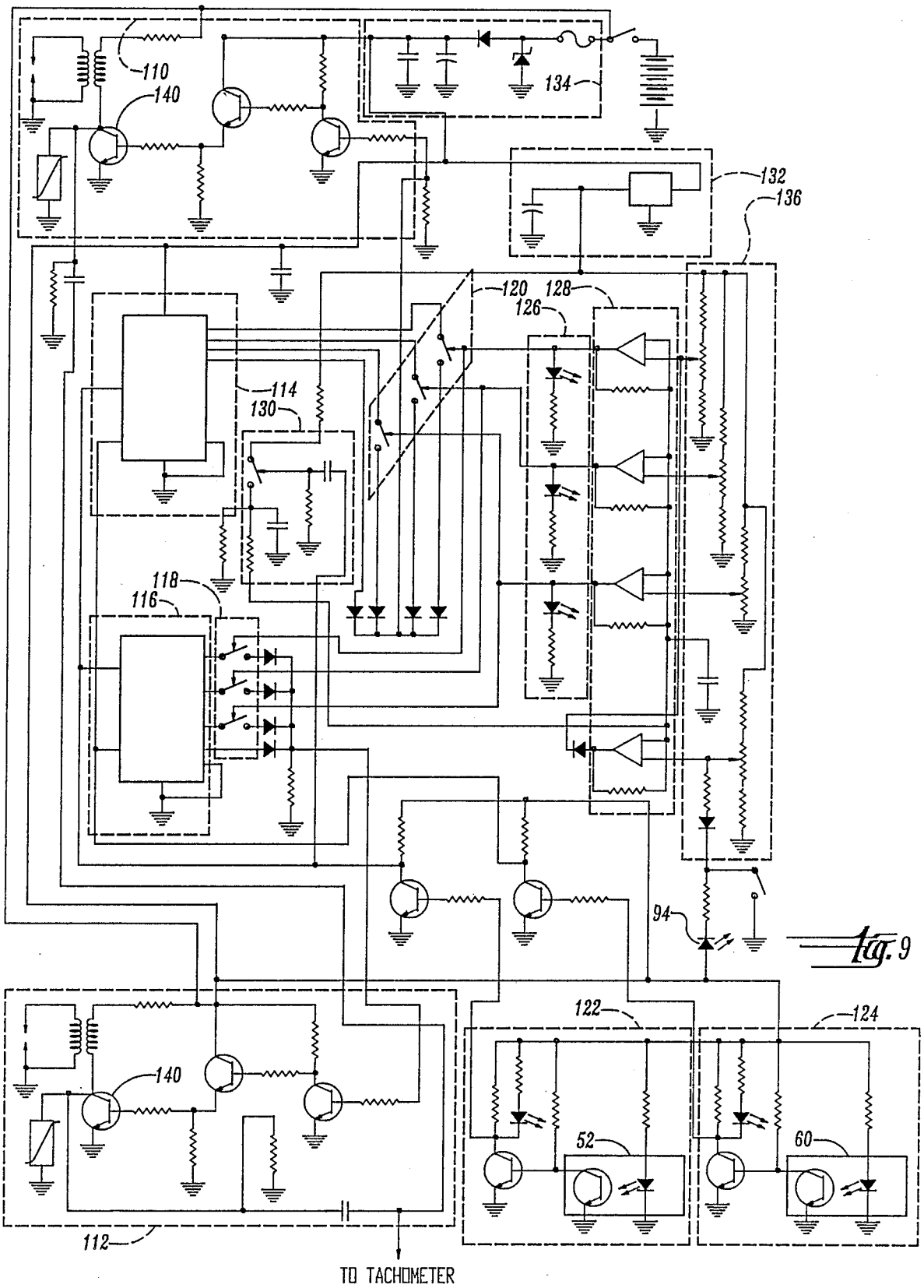
FIG. 9 is a schematic diagram of the electrical components shown in FIG. 8.

Referring to the schematic of FIG. 9, the various components are constructed of conventional parts commercially available. The preferred transistor designated by the numeral 140 in the drawing is manufactured by Texas Instrument Corporation under the product designation TIPL757A. Another transistor which will work satisfactorily is a chip manufactured by Motorola under the product designation MJ13101. The selection of these chips is important in order to obtain a quick shutoff of the driving signal to the ignition coil.

Referring again to FIG. 7, a trigger plate simulator may be used to initially set the set screws 82, 83, 84, and 86. The set screws may be set by reving the engine to the particular desired rpms as registered on the tachometer. When the desired rpms for a change of the spark advance is achieved, the switch 82 is rotated until the LED 88 becomes lit. Then the engine rpms are increased to the second desired level of change, and set screw 83 is rotated until both LEDs 88 and 90 are lit. Similarly, the adjustment is made with set screw 84 at a different rpms until all three lights 88, 90, and 92 are lit.

Figure 10:
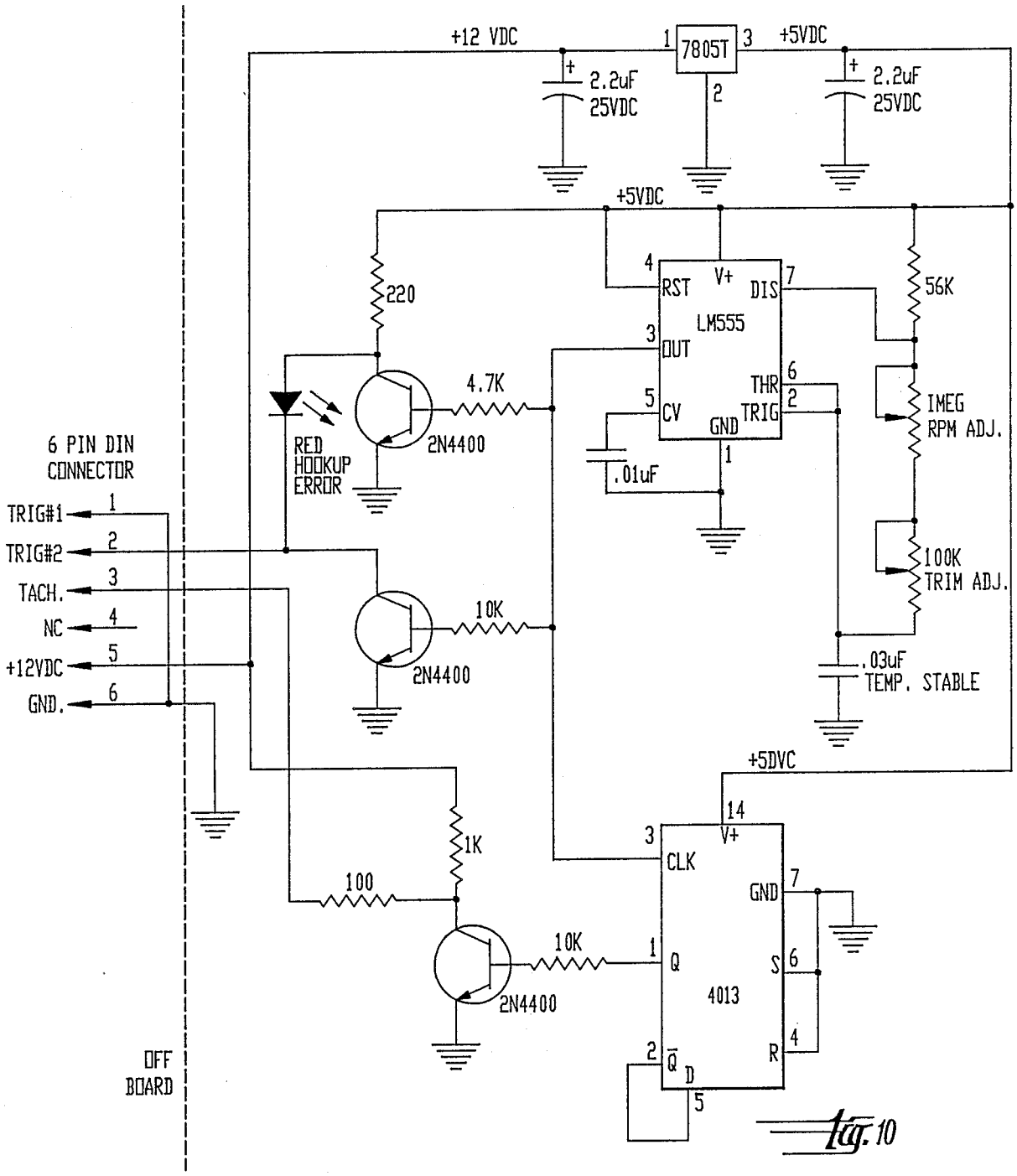
FIG. 10 is a schematic diagram of the electrical circuitry within the trigger plate simulator which may be used with the present invention.

The trigger plate simulator 142 shown in FIG. 7 may be connected to the device by detachable sockets 144, 146, and is capable of creating a simulated signal to the pulse voltage converter. The simulated signal corresponds to the signal normally encountered by the pulse voltage converter 130 during operation of the engine, but the trigger plate simulator creates the signal without the engine running. An adjustment knob 148 permits the operator to adjust the simulated signal which is being sent to the voltage converter so that it corresponds to various rpms of the engine. It is thus possible to set the adjustment screws 82, 83, 84, and 86 at various rpm levels by adjusting the trigger plate simulator to those desired levels and making the appropriate adjustments with screws 82, 83, and 84. FIG. 10 is a schematic diagram of the electrical circuitry of the trigger plate simulator.

Thus, it can be seen that the device accomplishes at least all of its stated objectives. The operator can field adjust the spark advance quickly and easily. If it is desired to change the rpm level at which the spark advance changes, the operator merely needs to adjust the set screws 82, 83, 84, and 86 to the desired rpm levels. If it is desired to change the degrees of spark advance at each level, it is merely necessary to remove pins 1, 2, 3, and 4 and relocate them at the desired location for creating the desired degrees of spark advance. Use of electrical circuitry to control the spark advance is more precise and more easily controlled than in prior devices. The present invention has application for internal combustion engines using any number of cylinders, and it is merely necessary to provide a separate optical sensor such as sensors 52, 60 for each cylinder to be fired. The device is easily adaptable to internal combustion engines of any type and can be quickly and easily used to replace present ignition systems in those devices.

We claim:

1. An ignition timing system for an internal combustion engine having at least one cylinder, a piston mounted within said cylinder for reciprocating movement therein, and a camshaft connected to said piston, said camshaft being rotatable 360 degrees during reciprocating movement of said piston and having a zero degree rotational position corresponding to a predetermined position of said piston within said cylinder, a spark plug within said cylinder, and an electrical firing means connected to said spark plug for delivering a periodic electric firing signal to said spark plug, said ignition timing system comprising:

a timing system housing;

a rotor plate within said housing and having an upper surface, a lower surface, and a perimetric edge;

connecting means for connecting said rotor plate to said camshaft so as to cause said rotor plate to rotate about a rotor plate axis, in response to rotation of said camshaft;

at least a first trigger member;

said rotor plate having a plurality of trigger mounting means circumferentially spaced from one another radially outwardly from said rotor plate axis;

said first trigger member being selectively mounted to one of said trigger mounting means for rotation in unison with said rotor plate;

sensing means mounted to said system housing in a stationary position relative to said rotor plate during rotation of said rotor plate, said sensing means being positioned so that said first trigger member periodically passes closely adjacent thereto during each revolution of said rotor plate, said sensing means being capable of transmitting a first trigger signal each time said first trigger member passes closely adjacent thereto;

electrical ignition circuitry connected to said sensing means and said firing means for causing said firing signal to be delivered to said spark plug each time said sensing means transmits said first trigger signal.

2. An ignition system according to claim 1 wherein additional trigger members 2—n are detachably mounted to separate ones of said trigger mounting means in a plurality of positions spaced circumferentially around said rotational axis of said rotor plate, each of said first trigger member through said nth trigger member creating corresponding first through nth trigger signals when passing closely adjacent said sensing means during rotation of said trigger plate, said ignition circuitry being capable of selecting predetermined ones of said first through nth trigger signals for causing said firing signal to be delivered to said spark plug.

3. An ignition system according to claim 2 wherein said ignition circuitry includes converter means for creating an rpm signal in response to the frequency of said trigger signals, said rpm signal corresponding to the rotational speed of said camshaft.

4. An ignition system according to claim 3 wherein said ignition circuitry includes comparator means for comparing said rpm signal to a first through nth set of preselected rpm signal characteristics, said comparator causing said firing signal to be generated simultaneously with only said nth trigger signal when said rpm signal is of said nth signal characteristics.

5. An ignition timing system according to claim 4 and further comprising a trigger simulator connected to said converting means, said trigger simulator being adapted to send a periodic simulated trigger to said converting means so as to cause said converting means to create said rpm signal and send said rpm signal to said comparator means.

6. An ignition timing system according to claim 5 wherein said trigger simulator includes means for selectively changing said simulated trigger signal to simulate different trigger signals caused by different rotational speeds of said camshaft.

7. An ignition timing system according to claim 1 wherein said sensing means comprises an optical sensor.

8. An ignition timing system according to claim 7 wherein said trigger members comprise pegs and said trigger mounting means comprise holes in said rotor plate for detachably retentively receiving said pegs.

9. An ignition timing system according to claim 1 wherein said sensing means is adjustably mounted to said housing to permit adjustment of the position of said sensing means relative to said trigger plate.

10. An ignition timing system according to claim 2 wherein a second sensing means is mounted to said housing for transmitting a second set of first through nth trigger signals in response to said first through nth trigger members each passing closely adjacent said second sensing means, said electrical circuitry being capable of selecting predetermined ones of said first through nth trigger signals of said second set for creating a second firing signal.

11. A method for timing the ignition of a spark plug of an internal combustion engine having a cylinder, a piston mounted for reciprocating movement within said cylinder, and a camshaft connected to said piston and rotatable 360 degrees during reciprocating movement of said piston, said camshaft having a zero degrees rotational position corresponding to a predetermined position of said piston within said cylinder, said method comprising:

connecting a trigger plate to said camshaft for rotation of said trigger plate about a trigger plate axis in response to rotation of said camshaft;

detachably mounting 1—n trigger members on said trigger plate in a plurality of circumferentially spaced positions on said trigger plate;

sensing when each of said 1—n trigger members pass closely adjacent a stationary location near said trigger plate during rotation of said trigger plate;

creating 1—n trigger signals in response to and corresponding to said 1—n trigger members passing closely adjacent said stationary location;

using electrical circuitry to analyze said 1—n trigger signals to create an rpm signal corresponding to the rotational speed of said camshaft;

programming said circuitry with 1—n distinctive signal characteristics for said rpm signal, each of said 1—n signal characteristic corresponding to one of said 1—n trigger signals respectively;

comparing the characteristics of said rpm signal to said 1—n signal characteristics programmed into said circuitry;

creating a firing signal which is timed simultaneously with one of said 1—n trigger signals corresponding to the one of said 1—n signal characteristics matching the signal characteristic of said rpm signal;

continuing to change the timing of said firing signal during changes of the rotational speed of said camshaft so that said firing signal occurs simultaneously with the one of said 1—n trigger signals corresponding to the one of said 1—n signal characteristic levels matching the signal characteristic of said rpm signal.

* * * * *